US009711301B2

(12) United States Patent
Plancherel et al.

(10) Patent No.: US 9,711,301 B2
(45) Date of Patent: Jul. 18, 2017

(54) KEYBOARD ILLUMINATED SWITCH CIRCUIT

(71) Applicant: Logitech Europe S.A., Lausanne (CH)

(72) Inventors: Laurent Plancherel, Lausanne (CH); Kuo Hsiang Chen, Miaoli County (TW)

(73) Assignee: Logitech Europe S.A., Lausanne (CH)

( * ) Notice: Subject to any disclaimer, the term of this patent is extended or adjusted under 35 U.S.C. 154(b) by 12 days.

(21) Appl. No.: 14/856,921

(22) Filed: Sep. 17, 2015

(65) Prior Publication Data

US 2016/0079011 A1 Mar. 17, 2016

Related U.S. Application Data

(60) Provisional application No. 62/051,551, filed on Sep. 17, 2014.

(51) Int. Cl.

*H01H 13/14* (2006.01)
*H01H 13/02* (2006.01)
*H01H 13/86* (2006.01)

(52) U.S. Cl.

CPC ..... *H01H 13/14* (2013.01); *H01H 13/023* (2013.01); *H01H 13/86* (2013.01); *H01H 2207/02* (2013.01); *H01H 2219/03* (2013.01); *H01H 2219/036* (2013.01); *H01H 2219/056* (2013.01); *H01H 2219/062* (2013.01); *H01H 2223/012* (2013.01); *H01H 2223/03* (2013.01); *H01H 2223/054* (2013.01)

(58) Field of Classification Search

CPC ..... H01H 13/14; H01H 13/023; H01H 2219/036; H01H 13/86; H01H 2207/02; H01H 2223/054; H01H 2219/03; H01H 2219/056; H01H 2219/062; H01H 2223/012; H01H 2223/03; H01H 2219/014

USPC ..... 200/310–315, 521, 513, 341

See application file for complete search history.

(56) References Cited

U.S. PATENT DOCUMENTS

| | | | | |
|---|---|---|---|---|
| 5,302,789 | A * | 4/1994 | Hellman, Sr. | H01H 1/2083 200/243 |
| 5,408,060 | A | 4/1995 | Muurinen | |
| 6,191,682 | B1 * | 2/2001 | Wolfgang | B60R 25/2063 200/61.45 R |
| 6,860,612 | B2 | 3/2005 | Chiang | |
| 7,071,433 | B2 * | 7/2006 | Holscher | H01H 13/785 200/310 |
| 7,283,066 | B2 | 10/2007 | Shipman | |
| 8,253,048 | B2 * | 8/2012 | Ozias | H01H 13/83 200/314 |
| 2014/0168936 | A1 | 6/2014 | Chen et al. | |

* cited by examiner

*Primary Examiner* — Edwin A Leon
(74) *Attorney, Agent, or Firm* — Kilpatrick Townsend & Stockton LLP

(57) ABSTRACT

Embodiments of the present invention provide a circuit structure that allows the use of a single sided Printed Circuit Board (PCB) with a mechanical key structure that has a light emitting element in the middle of the key structure. An LED with pins for protruding through a printed circuit board allows a layout only on the bottom side of the PCB. In one embodiment, the PCB includes at least one low ohm resister forming a bridge for a switch matrix conductor over a perpendicular switch matrix conductor.

7 Claims, 7 Drawing Sheets

KEYBOARD ILLUMINATED SWITCH CIRCUIT

CROSS-REFERENCES TO RELATED APPLICATIONS

This application is a nonprovisional of and claims the benefit of priority of U.S. Provisional Application No. 62/051,551, entitled, "Keyboard Illuminated Switch," filed on Sep. 17, 2014, which is herein incorporated by reference in its entirety for all purposes

BACKGROUND OF THE INVENTION

The present invention relates to illuminated keys in mechanical keyboards.

There are many different types of keyboards. Some well-known keyboards are capacitive (non-mechanical) and mechanical. Mechanical keyboards include membrane (rubber dome) and metal contact (with a spring) keyboards. Membrane keyboards are used for lower profile keyboards, and have a rubber dome that is depressed to actuate a switch. Other mechanical keyboards use a spring mechanism. The spring sometimes takes the form of a scissors mechanism. Mechanical keyboards are often used for gaming, for example.

FIG. 1 is a diagram of a prior art Cherry™mechanical key switch for a mechanical keyboard. A spring 102 is mounted in the center below a plunger/actuator mechanism 104. Off to the side are vertically arranged wire contacts 106 and 108 which are opened and closed by a member 110 as the plunger moves up and down. Not shown is a keycap mounted on top of plunger 104.

Illuminated keyboards can illuminate the keys, in particular the letters, numbers or other indicia on the keys. This has been done with light guides, or with LEDs in the keys themselves. An example of a light guide approach is in Shipman U.S. Pat. No. 7,283,066, Muurinen U.S. Pat. No. 5,408,060 and Chiang (Darfon) U.S. Pat. No. 6,860,612.

FIG. 2 is a diagram of a prior art illuminated key from US Published Application No. 20140168936. An LED 202 is mounted on the side of a scissors structure 204 supporting the keycap 206.

BRIEF SUMMARY OF THE INVENTION

Embodiments of the present invention provide a circuit structure that allows the use of a single sided Printed Circuit Board (PCB) with a mechanical key structure that has a light emitting element in the middle of the key structure.

In one embodiment, an LED with pins for protruding through a printed circuit board is used. This allows a layout on the bottom side of the PCB, simplifying the manufacturing process. With the higher LED structure compared to a surface mount LED, no light guide is needed since the light emitting surface of the LED will be sufficiently close to the key cap.

In one embodiment, the PCB includes at least one low ohm resister forming a bridge for a switch matrix conductor over a perpendicular switch matrix conductor. In another embodiment, a third pin is included in the switch, with one of the electrical connections to the two switch pins being made internal to the switch, eliminating the need for a cross-over on the PCB.

DETAILED DESCRIPTION OF THE INVENTION

Example Key Structure with Center LED Mount to Support the Invention

Figure 1:
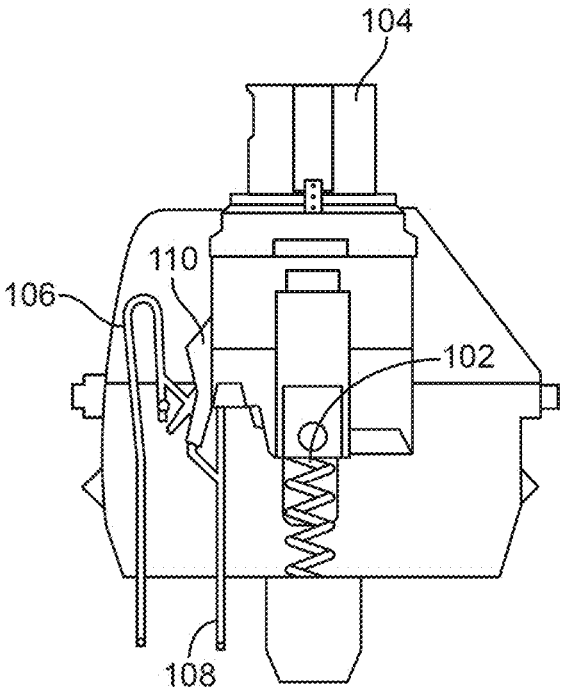
FIG. 1 (PRIOR ART)
FIG. 1 is a diagram of a prior art plunger and switching key mechanism.
Figure 2:
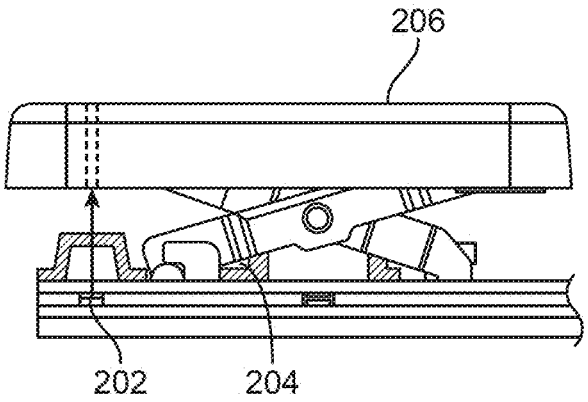
FIG. 2 (PRIOR ART)
FIG. 2 is a diagram of a prior art illuminated key with a light emitter on one side.
Figure 3:
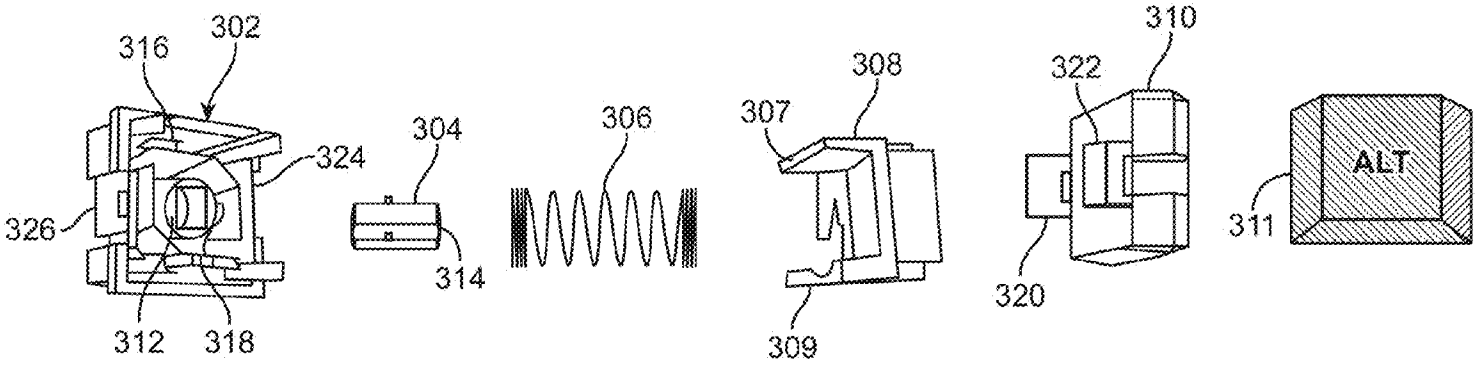
FIG. 3 is an exploded view of the elements of a key structure according to an embodiment of the invention.

FIG. 3 is an exploded view of the elements of a center LED mount key structure. The key structure includes a base 302, a light guide 304, a spring 306, a plunger/actuator 308, a plunger holder 310 and a key cap 311. Base 302 includes a central hole 312 for an LED.

Contact wires 316 and 318 are arranged horizontally around the central hole 312. By extending each wire around a corner of the switch base, a spring force is provided. The corresponding separation points near a second corner provide maximum leverage for the spring. The sidewalls 307 and 309 of the plunger 308 are able to separate the spring biased contact portions near the corners.

Light guide 304 will be mounted over the LED. A Plated Through Hole (PTH) LED is used without light guide 304. PTH LED will be taller than a SMD LED, thus eliminating the need for the light guide. In one embodiment, it is a 3 mm LED.

The top of light guide 304 can have a diffusion pattern 314 for diffusing the light to key cap 311. Key cap 311 is mounted over plunger 308. The letters "ALT" appears on the key cap in translucent manner, with the rest of the key cap being black or other opaque material. Other key caps have different letters or numerals for backlighting. Alternately, the whole or a portion of the key can be at least partially translucent to allow the key to glow when backlit.

Plunger holder 310 includes a pair of tabs 320 and 322 which interlock with portions 324 and 326 of base 302.

A number of variations of this structure are possible. For example, four smaller springs could be used at the corners of the key module. Alternately, a wide scissors mechanism could be used, with enough space between the scissor blades for an LED, and a large scissors axle with a hole large enough to accommodate an LED or light guide.

The light guide is rectangular to provide optimum distribution of light to a rectangular key cap. Alternately, for a circular key cap, a cylindrical light guide could be used. For a larger key, a wider light guide could be used. Other shapes for keycaps can have correspondingly shaped light guides. Alternately, a wider key can have multiple key plunger structures, with the extra structures having an LED, but not the switching contacts.

Figure 4:
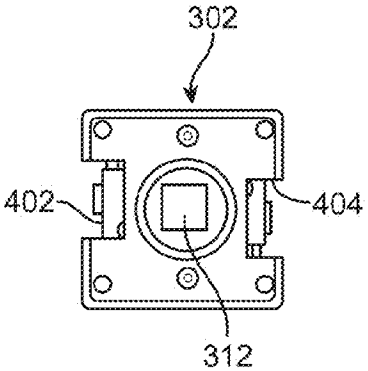
FIG. 4 is a diagram of the bottom surface of the base of the key structure of FIG. 3.

FIG. 4 is a diagram of the bottom surface of the base 302 of the key structure of FIG. 3. The same hole 312 in base 302 can be seen. In the bottom view, contact pins 402 and 404 are shown which will engage with an underlying PCB.

Figure 5:
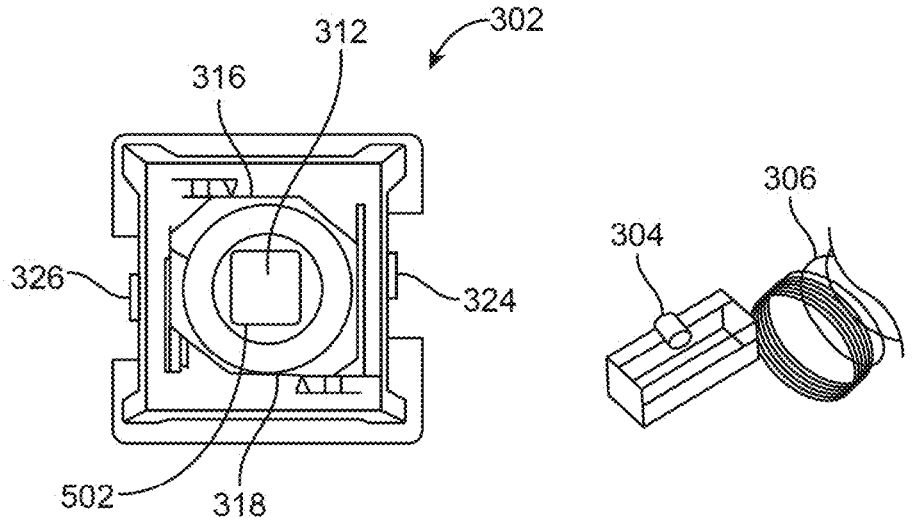
FIG. 5 is a diagram of the top portion of the base of FIG. 4.

FIG. 5 is a diagram of the top portion of the base 302 of FIG. 4. As described above in FIG. 3, and shown in a different view here, base 302 includes a central hole 312 for an LED. Contact wires 316 and 318 are arranged horizontally around the central hole 312. This figure gives a better view of a circular depression 502 in base 302 for engaging spring 306. Also shown again are light guide 304 and a portion of spring 306.

Figure 6:
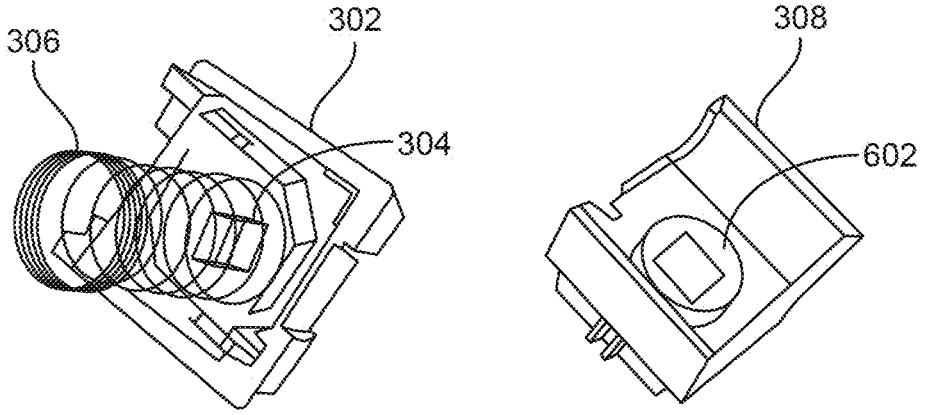
FIG. 6 is a diagram of a partially assembled key structure according to an embodiment showing the spring and light guides mounted.

FIG. 6 is a diagram of a partially assembled key structure according to an embodiment of the invention showing the spring and light guide mounted. As can be seen, base 302 has light guide 304 mounted over the central hole (312 of FIG. 3). Spring 306 is mounted to engage a circular depression 502 in base 302. Plunger 308 is shown from the bottom side, illustrating a circular indentation or depression 602 for engaging the other side of spring 306.

Figure 7:
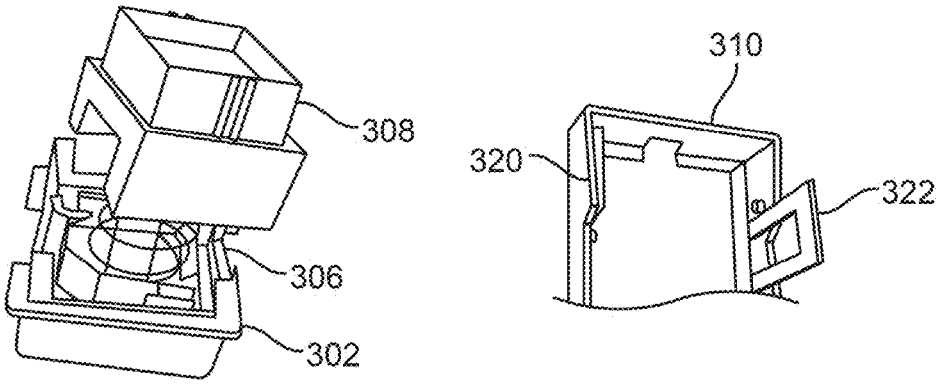
FIG. 7 is another diagram of a partially assembled key structure according to an embodiment including a plunger.

FIG. 7 is another diagram of a partially assembled key structure according to an embodiment of the invention including a plunger. Plunger 308 is shown mounted on spring 306 over base 302. Also, a view from the bottom of plunger holder 310 with locking tabs 320 and 322 is shown.

Figure 8:
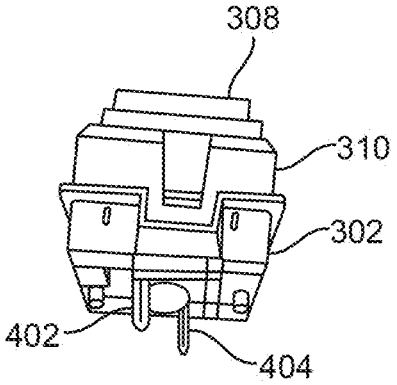
FIG. 8 is a diagram of a completed key structure according to an embodiment.

FIG. 8 is a diagram of a completed key structure according to an embodiment. This figure shows the assembled structure with plunger 308 extending through plunger holder 310 which is engaged with base 302. This figure gives a better view of the pins 402 and 404 extending below the base for engaging with an underlying PCB.

Figure 9:
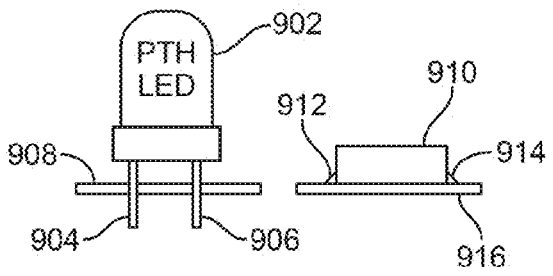
FIG. 9 is a diagram showing a plated through hole (PTH) LED and a surface mount device (SMD) LED as used in embodiments of the present invention.

FIG. 9 is a diagram showing a plated through hole (PTH) LED and a surface mount device (SMD) LED. A PTH LED 902 has a pair of pins 904 and 906 which extend through a PCB 908 to engage with a printed circuit on the bottom of the PCB by appropriate soldering or welding. A SMD LED has side contacts 912 and 914 for engaging with a circuit on the top of a PCB 916. Alternately, contacts 912 and 914 can be underneath LED 910.

Single Sided PCT Circuit According to Embodiments of the Invention

Figure 10:
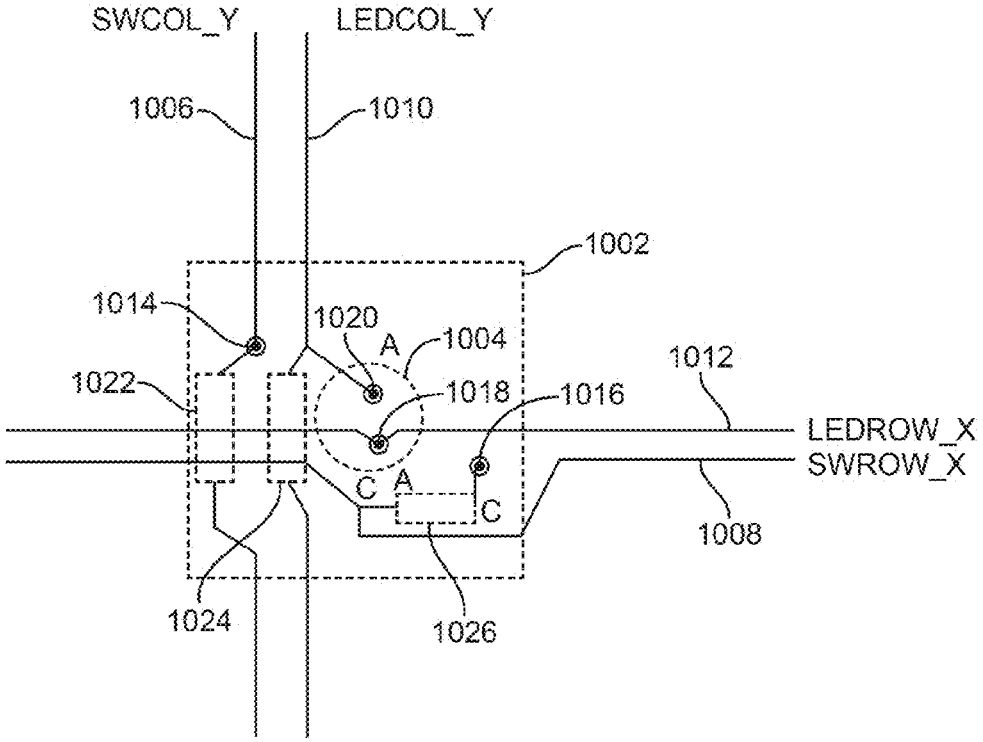
FIG. 10 is a diagram of a first circuit layout for a key switch PCB according to an embodiment of the invention.

FIG. 10 is a diagram of a first circuit layout for a key switch PCB according to an embodiment of the invention. FIG. 10 shows the underside of a PCB for a switch cell. Shown in phantom is where the switch 1002 will be on the top side of the PCB. Also shown in phantom is the outline of the LED 1004. Conductive trace 1006 is the column line for the switch. Conductive trace 1008 is the row line for the switch. Conductive trace 1010 is the column line for the LED. Conductive trace 1012 is the row line for the LED. Contacts 1014 and 1016 connect with the pins of the switch. Contacts 1018 and 1020 connect with the pins of the LED.

A pair of low ohm resistors 1022 and 1024, preferably 0 ohms, act as bridges for the cross-over of the column and row lines. This makes the layout on one side of the PCB practical. Zero-ohm resistors may be packaged like cylindrical resistors, or like surface-mount resistors. They can thus use the same automated equipment as for normal resistors to install them on the PCB. A SMD Schottky diode 1026 can be soldered below the switch on the bottom of the PCB.

Figure 11:
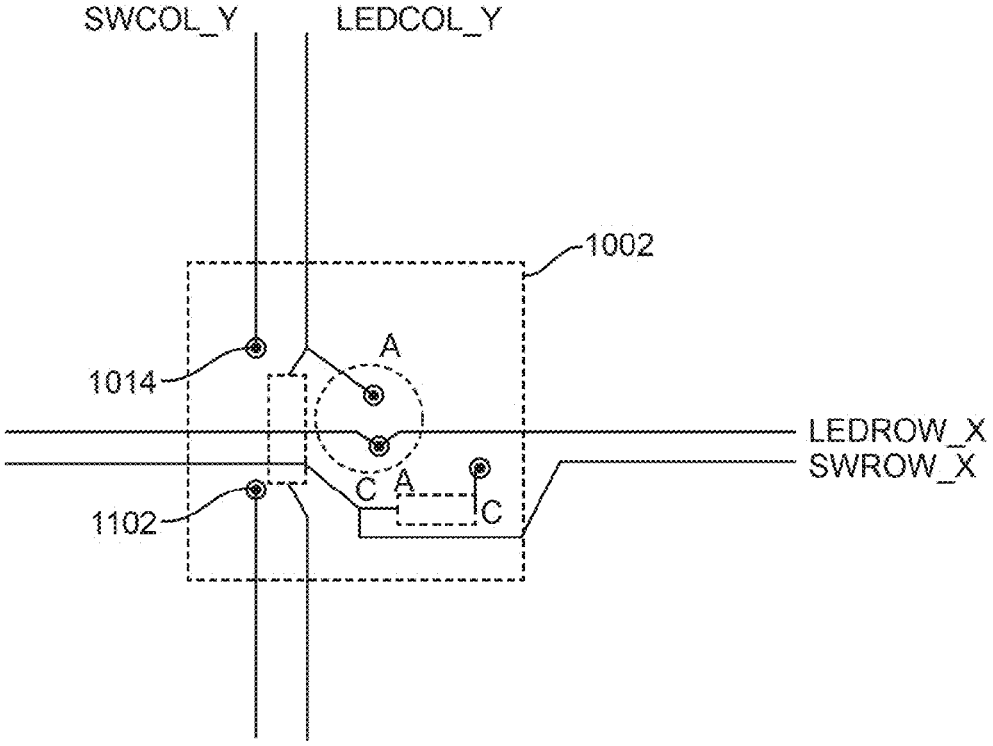
FIG. 11 is a diagram of a second circuit layout for a key switch PCB according to an embodiment of the invention.

FIG. 11 is a diagram of a second circuit layout for a switch PCB according to an embodiment of the invention. It is the same as FIG. 10 except that one of the 0 ohm resistors, resistor 1022 of FIG. 10, has been eliminated. Instead, a third switch pin 1102 is added. Inside the switch, pin 1102 is connected to the pin at contact 1014. Thus, the column line is completed inside the switch module.

Figure 12:
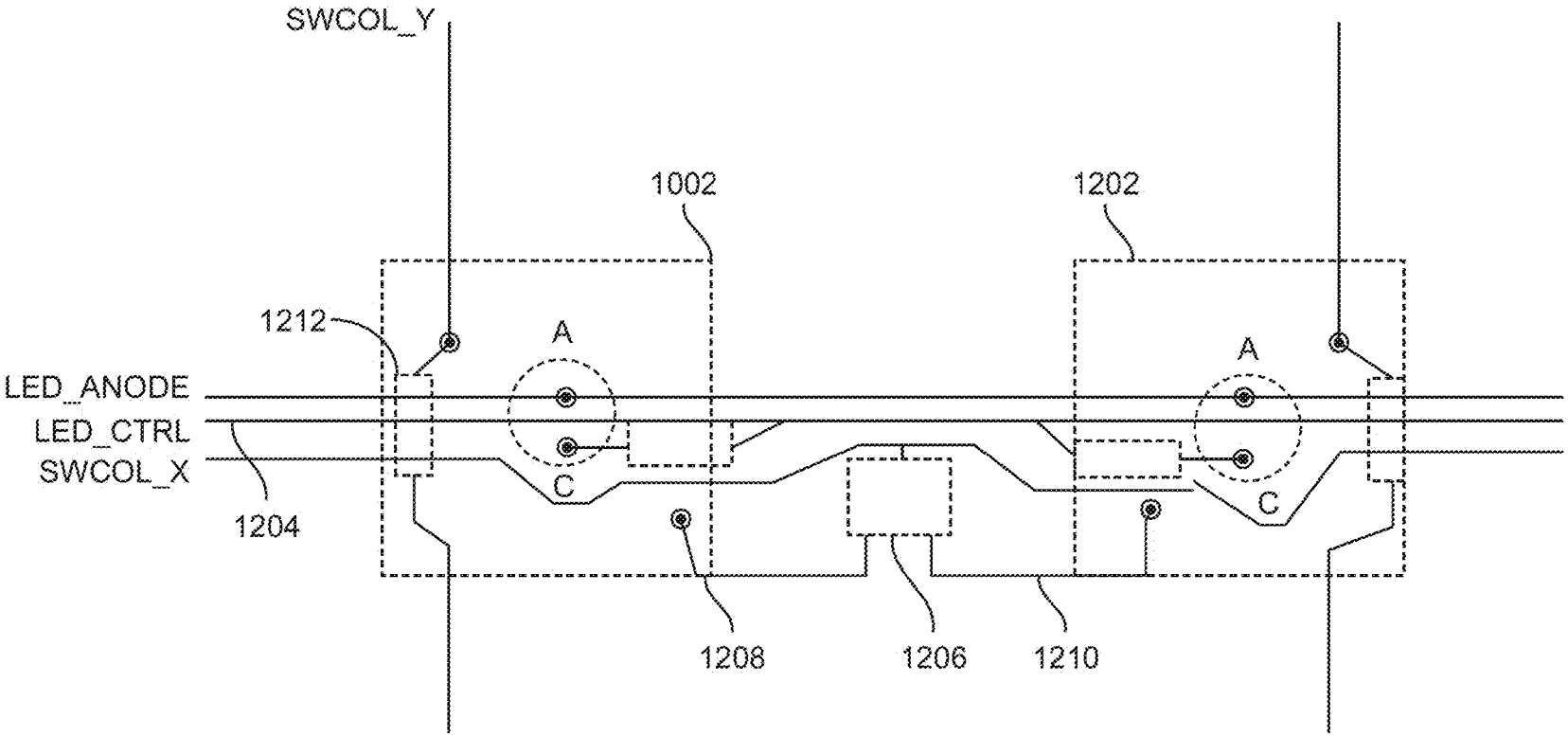
FIG. 12 is a diagram of a third circuit layout for a key switch PCB showing adjacent switch structures according to an embodiment of the invention.

FIG. 12 is a diagram of a third circuit layout for a switch PCB showing adjacent switch structures according to an embodiment of the invention. In this embodiment, all LEDs are connected in parallel, using a single control signal. Thus, the LED column line of FIGS. 10 and 11 is eliminated. The cells for switches 1002 and 1202 use a single LED control trace 1204.

Also shown is a dual diode 1206 connected between lines 1208 and 1210, connected to switch pins of switches 1002 and 1202. By rotating the switch by 90°, the soldering pads will be flipped (mirrored). This will make it possible to use a dual diode package (e.g., BAT54). A single bridge 1212, over 3 lines, is used per switch. Since low current flows through this 0 ohm bridge, carbon tracks (Carbon Conductive Ink) can be used as a cross-over in another embodiment.

Alternate Embodiments

Although the invention has been described with respect to specific embodiments, it will be appreciated that the invention is intended to cover all modifications and equivalents within the scope of the following claims. For example, light emitters other than LEDs could be used. The LED can be a mono-color or multicolor LED. LEDs and switches with more pins could be used, with corresponding changes to the PCB layout traces. Accordingly, the foregoing described embodiments are intended to be illustrative, but not limiting, of the scope of the invention which is set forth in the following claims.

What is claimed is:

1. A key structure for a key on a keyboard comprising:

a printed circuit board having circuit traces only on a bottom side;

a key base mounted over the printed circuit board and having a central opening;

a key spring mechanism disposed on the base;

a moveable actuator disposed on the spring mechanism;

a pair of key switch contacts connected to first and second key pins;

the key pins extending through the printed circuit board;

a PTH (Plating Through Hole) LED (Light Emitting Diode) having a pair of pins extending through the printed circuit board; and a circuit on the bottom of the printed circuit board, the circuit including a bridge for a switch matrix conductor over a perpendicular switch matrix conductor.

2. The key structure of claim 1 wherein said bridge is a zero ohm resistor.

3. The key structure of claim 1 wherein said bridge is a carbon track.

4. The key structure of claim 1 further comprising a third switch pin, with a connection the second switch pin internal to the key base, the third switch pin being sufficiently separated from the second switch pin to allow the connection internal to the base to cross over one of a row and column trace on the printed circuit board.

5. The key structure of claim 1 further comprising:

a second, adjacent switch structure having a second LED, the LEDs being connected in parallel using a single control signal trace.

6. The key structure of claim 5, further comprising:

a dual diode connected to switch pins of the two switch structures.

7. A key structure for a key on a keyboard comprising:

a printed circuit board having circuit traces only on a bottom side;

a key base mounted over the printed circuit board and having a central opening;

a key spring mechanism disposed on the base;

a moveable actuator disposed on the spring mechanism;

a pair of key switch contacts connected to first and second key pins;

the key pins extending through the printed circuit board;

a PTH (Plating Through Hole) LED (Light Emitting Diode) having a pair of pins extending through the printed circuit board;

a circuit on the bottom of the printed circuit board, the circuit including a bridge for a switch matrix conductor over a perpendicular switch matrix conductor, wherein said bridge is one of a zero ohm resistor and a carbon trace; and a third switch pin, with a connection the second switch pin internal to the key base, the third switch pin being sufficiently separated from the second switch pin to allow the connection internal to the base to cross over one of a row and column trace on the printed circuit board.

* * * * *